United States Patent [19]

Lentz

[11] 4,354,332

[45] Oct. 19, 1982

[54] PLASTER AND DRY WALL HOLE REPAIR

[76] Inventor: Arthur H. Lentz, 908 Brantley Rd., Richmond, Va. 23235

[21] Appl. No.: 145,202

[22] Filed: Apr. 29, 1980

[51] Int. Cl.[3] ..... E04G 23/00

[52] U.S. Cl. ..... 52/514; 264/36

[58] Field of Search ..... 264/36; 52/514, 787, 52/743

[56] References Cited

U.S. PATENT DOCUMENTS

| | | | |
|---|---|---|---|
| 2,598,194 | 5/1952 | Shippey . | |
| 3,373,467 | 3/1968 | Loughrey | 52/514 |
| 3,662,805 | 5/1972 | Sygnator | 52/787 |
| 3,919,021 | 11/1975 | Whittle | 264/36 |
| 3,999,347 | 12/1976 | Devlin | 52/514 |
| 4,100,712 | 7/1978 | Hyman | 52/514 |
| 4,193,243 | 3/1980 | Tiner | 52/514 |

FOREIGN PATENT DOCUMENTS

| | | | |
|---|---|---|---|
| 2721696 | 11/1978 | Fed. Rep. of Germany | 264/36 |
| 1558174 | 12/1979 | United Kingdom | 52/743 |

*Primary Examiner*—Price C. Faw, Jr.
*Assistant Examiner*—Henry E. Raduazo
*Attorney, Agent, or Firm*—Griffin, Branigan & Butler

[57] ABSTRACT

A backing plate (11) is positioned to cover a hole (13) on a backside (14) of a wall (15). Integral with the backing plate (11) is a fastener (21) which protrudes through the hole (13) in the direction of a frontside (16) of the wall (15). The hole (13) is filled from the frontside (16) with a patching material before a dam (27) is positioned over the hole (13). The dam (27) accommodates the fastener (21) so that fastener (21) can be tightened for exerting pressure on the patching material between the dam (27) and the backing plate (11).

8 Claims, 5 Drawing Figures

PLASTER AND DRY WALL HOLE REPAIR

This invention relates to the repair of holes in plaster or dry wall construction.

BACKGROUND

Holes in dry wall or plaster wall construction have been repaired in the past by replacing entire sections with a cutout section of dry wall sized to fit the hole and then taping the joint to cover the crack where the patch joins the existing wall. Unless a stud happens to be in the space behind the hole, the structure is very weak since there is no backup or backing to hold the patch in place.

In trying to overcome this problem, some methods for patching holes in dry walls have been developed which incorporate fairly complex kits that are expensive to manufacture. Existing methods, however, do not provide an adequate means for containing both the rear and front surfaces of the patching material in a hole while it is drying or setting up.

SUMMARY OF THE INVENTION

A method and apparatus for repairing a hole in plaster or dry wall construction has a backing plate with a hole or plurality of holes drilled near its midsection. The backing plate may be cut from scrap material and dimensioned to fit through the longest dimension of the hole in the wall. A self-threading tapered screw is threaded into a drilled hole in the backing plate and is used as a handle to maneuver the backing plate through the hole in the wall and position it on the back side of the wall to substantially completely cover the entire hole. When the hole is large, small, and/or irregular, two or more self-threading screws may be secured to the backing plate to facilitate manuvering the backing plate into proper position.

The backing plate is held firmly in position while patching material is trowelled into the hole completely filling the hole up to the front surface of the wall. A front plate or dam having a key-hole or slot is slid under the enlarged head of the tapered screw and positioned against the patching material flush with the front side of the wall. The tapered screw is then tightened down causing the dam and back plate to exert pressure against the patching material in the hole. When the patching material has set up, the tapered screw is unscrewed and removed. The dam is removed from the front of the dry patching material, and the small hole left by the tapered screw is filled with patching material. The backing plate is integrated into the construction patch and left in place.

This provides a simple method for patching a hole in a dry wall with an economical, easy to manufacture apparatus that can be used over and over again. Only a backing plate which may be cut from scrap material remains with the patching material in the patched hole.

The foregoing and other objects, features, and advantages of the invention will be apparent from the following more particular description of a preferred embodiment of the invention, as illustrated in the accompanying drawings in which like reference characters refer to the same parts throughout the different views. The drawings are not necessarily to scale, emphasis instead being placed upon illustrating the principles of the invention.

DESCRIPTION OF A PREFERRED EMBODIMENT

Figure 1:
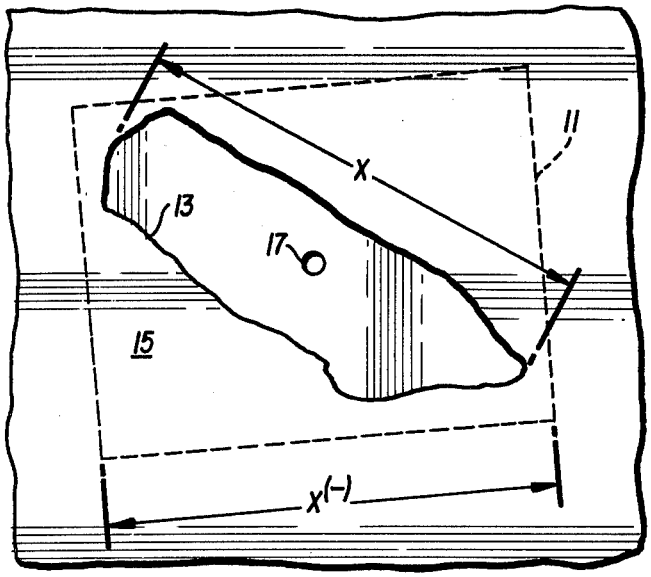
FIG. 1 is a schematic illustration of a portion of a hole-damaged wall with a backing plate in position.

As illustrated in FIG. 1, a dry wall or plaster wall hole repair apparatus has a backing plate 11 which is sized to have one dimension $X^{(-)}$ slightly less than a largest dimension X of a hole 13 in a dry wall or plaster wall 15. The backing plate 11 may be cut from available scrap material such as wood, sheet metal or the like, and is also sized to cover the hole 13 on a backside 14 of the wall 15. Since the backing plate 11 will eventually be maneuvered through the hole 13 as hereinafter described, it is preferable that the backing plate 11 be only as thick as necessary. In this regard, while the invention can be practiced with thicker backing plates 11, thinner backing plates 11 are often easier to maneuver.

Figure 2:
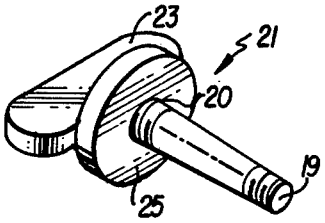
FIG. 2 is a schematic side view of a tapered screw.

The backing plate 11 has a hole 17 or a plurality of holes drilled through its center to accept a threaded end 19 of a tapered screw 21. If the hole 13 is large, small, and/or irregular, a plurality of tapered screws 21 may be used. As illustrated in FIG. 2, the tapered screw 21 has a shank 20 and an enlarged head 23 for ease of handling. The enlarged head 23 has a flat surface 25 on its underside.

Figure 3:
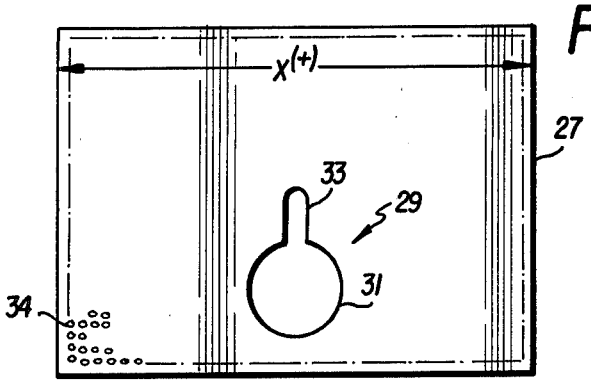
FIG. 3 is a front view of a dam.

A front plate or dam 27 is sized to have its main dimension $X^{(+)}$ slightly larger than the hole 13; and, as can be seen in FIG. 3, has a keyhole 29 whose hole 31 is large enough to allow passage of the enlarged head 23 of the tapered screw 21. A slot 33 of the keyhole 29 is sized to accept the threaded end 19 and shank 20 of the tapered screw 21. The flat surface 25 on the underside of the enlarged head 23 of the tapered screw 21 seats against the surface of the dam 27 in the area surrounding the slot 33.

In operation, the threaded end 19 of the tapered screw 21 is tightened firmly into the hole 17 of the backing plate 11. In the case of a large, small, and/or irregularly shaped hole 13, a plurality of tapered screws 21 may be secured in the holes 17 of the backing plate 11. The backing plate 11 is then maneuvered through the hole 13 at its widest dimension X. The enlarged head 23 of the tapered screw 21 is used as a handle to maneuver the backing plate 11 into position behind the hole 13 and flush against the backside 14 of the dry wall or plaster wall 15. If more than one tapered screw 21 is used, then all but one of the tapered screws 21 are unscrewed and removed once the backing plate 11 is in proper position behind the hole 13.

While the backing plate 11 is held in position behind the hole 13 using the enlarged head 23 of the tapered screw 21 as a handle, spackling compound, patching plaster or other patching material is trowelled into the hole filling it up level flush with the front surface of the dry wall or plaster wall 15. Then the keyhole 29 of the dam 27 is placed over the enlarged head 23 of the screw 21 and the dam is positioned flush against the exposed surface of the patching material. The dam 27 is slid down under the flat surface 25 of the enlarged head 23 of the tapered screw 21 as the slot 33 of the keyhole 29 is slid down over the shank 20 of the threaded end 19.

Figure 4:
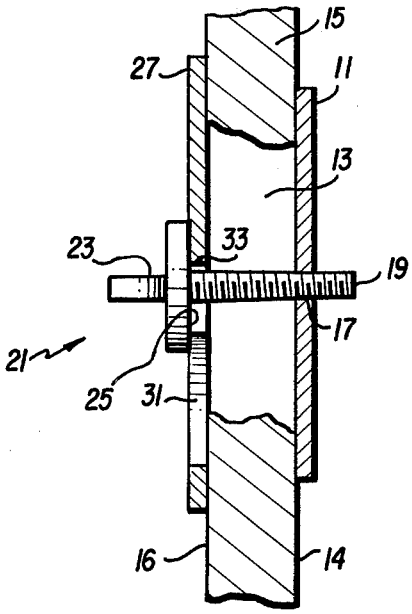
FIG. 4 is a schematic side view of the repair apparatus in position.

As illustrated in FIG. 4, the tapered screw 21 is tightened through the hole 17 of the backing plate 11 until the flat surface 25 of its enlarged head 23 is drawn up tight against the front surface of the dam 27 holding it in position against the front side 16 of the wall 15 and the patching material in the hole 13. The tapered screw 21 is then tightened more to exert pressure between the dam 27 and the backing plate 11 on the patching material compressing it until the dam 27 is flush with the front surface of the dry wall or plaster wall 15.

The front plate or dam 27 is left in position against the patching material until it has set up. Then the tapered screw 21 is unscrewed from the hole 17 and removed from the keyhole 29 releasing the dam 27. The dam 27 is removed from its position over the dry patching material on the front side 16 of the wall 15. The hole left by the shank of threaded end 19 of the tapered screw 21 is filled with patching material.

The backing plate 11 is integrated into the construction patch and left in position on the backside 14 of the wall 15 reinforcing the patched area.

In one embodiment, as partially illustrated in FIG. 3, the dam 27 has a plurality of small holes or perforations 34 extending through its thickness to facilitate the setting up and drying of patching material. Likewise, a plurality of like perforations are also drilled in the backing plate 11 for the same purpose. The perforations 34 may either be arranged randomly or in a pattern.

Figure 5:
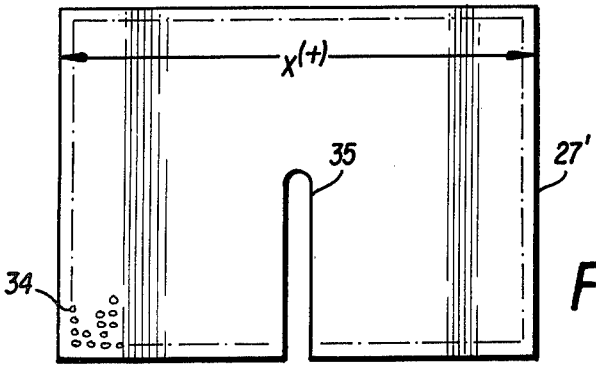
FIG. 5 is a front view of another embodiment of a dam.

In another embodiment illustrated in FIG. 5, a front plate or dam 27′ has a slot 35 the width of the shank 20 of the tapered screw 21 extending from one side or a bottom edge of the dam 27′ to its center. This allows a repairman to maintain the backing plate 11 in its position against the backside 14 of the wall 15 covering the hole 13 by holding the enlarged head 23 of the tapered screw 21 while sliding the dam 27′ behind the flat surface 25 of the enlarged head 23 as the slot 35 is slid over the shank 20 of the tapered screw 21.

Although for purposes of illustration, I have shown preferred embodiments of my invention, it will be apparent to those skilled in the art that various changes in form, detail, and usage may be made therein without departing from the spirit and scope of the invention. For example, the size and shape of the invention may be modified for use in remodeling existing structures such as relocating electrical outlets or plumbing fixtures or installing insulation.

The embodiments of the invention in which exclusive property or privilege is claimed are defined as follows:

1. A method for repairing a hole in a front surface of a wall without having access to the back surface thereof, said method comprising steps of:

inserting a backing means through the hole to the back side of the wall, and thereafter controlling the position of said backing means from the front side of the wall to cover a portion of the backside of said wall with said backing means, said covered backside portion substantially encompassing said hole, said backing means having at least one adjustable fastening means attached thereto and protruding through said hole when said backing means covers said backside portion of said wall which is used for controlling the position of the backing means;

filling said hole in said wall with a patching material while holding said backing means in a position covering said backside portion of said wall with said fastening means from the front side of said wall;

thereafter positioning a dam means over a portion of a front side of said wall, said front-side portion substantially encompassing said hole, said dam means being adapted to receive said fastening means protruding through said hole;

thereafter tightening said fastening means of said backing means against said dam means so as to exert pressure on said patching material between said dam means and said backing means; and, removing said fastening means and said dam means from said front side portion of said wall.

2. The method of claim 1, further comprising the step of:

filling with said patching material a hole left by the removal of said fastening means from said front side portion of said wall.

3. The method of claim 1, further comprising the steps of:

drilling at least one hole in said backing means, said hole in said backing means being adapted to receive said fastening means; and inserting said fastening means into said hole in said backing means.

4. Apparatus for repairing holes in a wall, said apparatus comprising:

backing means for being inserted from the frontside of the wall through a hole in the wall to the backside thereof, and thereafter for covering a portion of the backside of said wall, said covered backside portion substantially encompassing said hole;

adjustable fastening means having an enlarged head and a shank portion and means engageable with said backing means, said adjustable fastening means being adapted to protrude through said hole in said wall when said backing means covers said backside portion for allowing one to control the position of the backing means from the frontside of the wall while said hole is filled with patching materials from the frontside of said wall;

dam means for thereafter covering a portion of the front-side of said wall, said frontside portion substantially encompassing said hole, and for coming into engagement with said fastening means as said fastening means protrudes through said patching materials in said hole for maintaining a fixed distance between said backing means and said dam means to thereby hold said patching material in said hole;

said dam means having a slot therein extending from a side edge of said dam means to a point near its center, said slot being of a width to allow passage therethrough of said shank of said fastening means, but not said enlarged head thereof.

5. The apparatus of claim 4 wherein said fastening means includes a self-threading tapered screw.

6. The apparatus of claim 4 wherein said dam means comprises a flat plate containing a plurality of perforations.

7. Apparatus for repairing holes in a wall, said apparatus comprising:

backing means for being inserted from the frontside of the wall through a hole in the wall to the backside thereof, and thereafter for covering a portion of the backside of said wall, said covered backside portion substantially encompassing said hole;

adjustable fastening means engagable with said backing means for protruding through said hole in said wall when said backing means covers said backside portion for allowing one to control the position of the backing means from the frontside of the wall while said hole is filled with patching material from the frontside of said wall;

dam means for thereafter covering a portion of the frontside of said wall, said frontside portion substantially encompassing said hole, and for coming into engagement with said fastening means as said fastening means protrudes through said patching material in said hole for maintaining a fixed distance between said backing means and said dam means to thereby hold said patching material in said hole;

said dam including a flat plate larger than said hole encompassed by said frontside portion of said wall and having a keyhole-shaped hole therein for accepting said fastening means, said keyhole-shaped hole having a substantially circular portion and a narrow slot portion; and, said fastening means comprising a shank which is accommodated by the narrow slot portion of said keyhole-shaped hole and an enlarged head which is accommodated by said circular portion of said keyhole-shaped hole.

8. The apparatus of claim 7 wherein said dam means comprises a flat plate containing a plurality of perforations.

* * * * *